US005704499A

United States Patent [19]

Wurzer et al.

[11] Patent Number: 5,704,499

[45] Date of Patent: Jan. 6, 1998

[54] SLACK ADJUSTING GRAVITY WEDGE FOR RAILWAY SLACKLESS DRAWBAR ASSEMBLY

[75] Inventors: Jeffrey D. Wurzer, Glenshaw; Peter Scott Mautino; Frank Lazzaro, both of Verona; Joseph L. Gagliardino, Pittsburgh, all of Pa.

[73] Assignee: McConway & Torley Corporation, Pittsburgh, Pa.

[21] Appl. No.: 697,878

[22] Filed: Aug. 30, 1996

[51] Int. Cl.[6] ..... B61G 9/00

[52] U.S. Cl. ..... 213/50

[58] Field of Search ..... 213/50, 56, 57, 213/62 R, 62 A, 67 R, 67 A, 72, 74

[56] References Cited

U.S. PATENT DOCUMENTS

| | | | |
|---|---|---|---|
| 4,531,648 | 7/1985 | Paton | 213/50 |
| 4,593,827 | 6/1986 | Altherr | 213/56 |
| 4,700,853 | 10/1987 | Altherr et al. | 213/50 |
| 4,946,052 | 8/1990 | Kaim et al. | 213/62 R |
| 5,000,330 | 3/1991 | Kaim et al. | 213/62 R |
| 5,080,242 | 1/1992 | Steffen et al. | 213/62 R |
| 5,133,467 | 7/1992 | Hawthorne et al. | 213/56 |
| 5,246,135 | 9/1993 | Radwill | 213/62 R |
| 5,312,007 | 5/1994 | Kaufhold et al. | 213/62 R |
| 5,360,125 | 11/1994 | Dawson et al. | 213/62 R |
| 5,593,051 | 1/1997 | Openchowski | 213/50 |

*Primary Examiner*—Mark T. Le
*Attorney, Agent, or Firm*—James Ray & Associates

[57] ABSTRACT

A non-binding, slack-adjusting, gravity wedge member for use in a railway slackless drawbar system, the wedge member having a pair of opposed friction faces at an inclined angle to each other, with a first of the faces having at least one recess therein adapted to receive an elastomeric body bonded therein such that an outer, flat surface of the elastomeric body is exposed and spaced outwardly from and parallel to the first face, such that the elastomeric body has an exposed outer flat surface of at least about 35 square inches, and a hardness of at least about 50 durometers.

20 Claims, 1 Drawing Sheet

SLACK ADJUSTING GRAVITY WEDGE FOR RAILWAY SLACKLESS DRAWBAR ASSEMBLY

FIELD OF THE INVENTION

The present invention relates generally to a slackless drawbar assembly for railway cars. More particularly, this invention relates to a new and improved slack adjusting, gravity wedge member for use within a conventional slackless drawbar railway car coupling arrangement, one face of which comprises an elastomeric material which not only provides a degree of cushioning and shock absorbing characteristics to the system, but also prevents, or at least minimizes, binding between the gravity wedge and the adjacent components to permit a dampened operational movement of the wedge member.

BACKGROUND OF THE INVENTION

Slackless drawbar assemblies have been in wide spread use in the railroad industry for a number of years for the purpose of coupling one end of a railway car to an adjacent end of another car. One such assembly is taught in U.S. Pat. No. 4,966,291, assigned to the assignee of the present invention, the disclosure therein is incorporated into this application by reference thereto. With the arrangement taught in that prior art reference, free and cushioned slack is eliminated from the inner connection between cars. This slack elimination substantially minimizes undesirable longitudinal train action forces as well as the undesirable run-in and run-out of slack between adjacent cars during reversal of buff and draft train actions. This arrangement further minimizes the generation of large forces due to relative acceleration between the cars thereby reducing detrimental wear and damage to car components and lading. Obviously, reduction of wear and damage to such car components results in reduced maintenance cost and the reduction in damage to lading, and in fewer damage claims which must be paid by the rail carrier.

In addition, the use of slackless drawbar assemblies as a railcar coupling means has reduced the car weight by approximately 650 pounds. Such reduced car weight is achieved through elimination of the need for standard couplers, yokes, cushioning devices and striker bars. Such reduction in the weight of these cars translates into lower fuel consumption, and therefore, lower operating costs. As should be apparent, the elimination of various car components further reduces the maintenance cost associated with these components.

As is commonly known, such draft gear commonly comprises an elongated, male drawbar pivotally attached to one car and having a hemispherical end retained with a pin within a support housing secured to the adjacent car by which draft loads are effectively transferred. To transfer buff loads, a female follower block disposed within the support housing and having a mating, hemispherical cavity, is disposed in a mating relationship against the hemispherical end of the drawbar, and tightly biased thereagainst by a gravity wedge disposed between the female follower block and a back wall portion of the support housing. By virtue of the force of gravity, the gravity wedge will maintain the female follower block tightly biased against the hemispherical end of the male drawbar to effectively transfer buff loads. Such slackless draft gear are well known in the art and need not be further described here.

In order to impart a minor degree resiliency to achieve cushioning and shock absorbing characteristics within the system, several unique designs have been proposed which incorporate an elastomeric pad or body within the system as either an elastomeric buffer plate, an elastomerically supported follower plate, or a combination of multiple wedge members, either of which is disposed adjacent to the follower plate member of the system. In such systems, the elastomeric element is provided as a additional element which is in one way or another biased between the gravity wedge and an adjacent surface against which the gravity wedge acts. In such prior art systems, it is common to bond metal strips to the exposed face surfaces of the elastomeric pad or body to assure that a frictional retaining force will maintain the wedge member in a vertically aligned position to assure gravity induced movement thereof in the ordinary course of maintaining the gravity wedge tightly disposed between the two surfaces it is to be biased between.

While these systems are adequate to meet their intended purposes for cushioning and shock absorbing, the inclusion of such added components not only adds complication to the systems by virtue of the added components, but also adds weight to the system. In addition, these elastomeric systems tend to cause the gravity wedge to bind or hang-up against the adjacent surfaces so that the desired freedom of gravitational induced motion is not assured.

SUMMARY OF THE INVENTION

The present invention provides a single piece gravity wedge member into which an elastomeric cushioning means is incorporated for providing a degree of cushioning and shock absorbing characteristics to the system without the need to include additional components and weight to the system. In addition, by incorporating the elastomeric pad directly into the wedge member itself, it has been found that metal strips for assuring frictional retaining forces can be eliminated to further achieve a degree of dampened operational movement to minimize binding and assure free gravity induced movement of the wedge member.

In its simplest form, the gravity wedge of this invention comprises a wedge-like cast steel member having a pair of opposed friction faces at an inclined angle to each other, with one of the faces having at least one recess therein adapted to receive an elastomeric body bonded therein such that an outer, flat surface of the elastomeric body is exposed and spaced outwardly from and parallel to the cast steel wedge face into which it is set. Ideally, the elastomeric body or bodies should have a hardness of at least about 50 durometers, and preferably 70 durometers, and provide at least about 35 square inches of exposed surface area, and preferably at least about 38 square inches of surface area.

OBJECTS OF THE INVENTION

It is, therefore, one of the primary objects of the present invention to provide a new and improved slack adjusting, gravity wedge member for use within a slackless drawbar railway car coupling arrangement that provides a degree of cushioning and shock absorbing characteristics to the system, and also to prevent, or at least minimize, binding between the gravity wedge and the adjacent components to permit a dampened operational movement of the wedge member.

Another object of this invention is to provide a new and improved slackless drawbar railway car coupling arrangement including an elastomeric means to provide cushioning and shock absorbing characteristics to the system, and reduce binding of the wedge to permit a dampened operational movement of the wedge member without adding heavy components to the system.

A further object of this invention is to provide a new and improved slackless drawbar railway car coupling arrangement having a gravity wedge including an elastomeric face which not only provides a degree of cushioning and shock absorbing characteristics to the system, but also prevents binding of the wedge to permit a dampened operational movement of the wedge member.

Still another object of this invention is to provide a new and improved replacement gravity wedge incorporating an elastomeric face that can readily be retrofitted to an existing slackless drawbar railway car coupling arrangement to provide a degree of cushioning and shock absorbing characteristics to the system, and also to prevent binding of the wedge to permit a dampened operational movement of the wedge member.

An even further object of this invention is to provide a new and improved slack adjusting, gravity wedge member for use within a conventional slackless drawbar railway car coupling arrangement into which is incorporated a wedge face having an exposed surface of an elastomeric material to provide cushioning and shock absorbing characteristics to the system, and prevent binding between the gravity wedge and the adjacent components to permit a dampened operational movement of the wedge member.

In addition to the above-identified objects and advantages of the present invention, various other objects and advantages of such invention will become more readily apparent to those persons who are skilled in the railway coupling art from the following more detailed description of the invention, particularly, when such description is taken in conjunction with the attached drawing figures and with the appended claims.

DESCRIPTION OF A PREFERRED EMBODIMENT OF THE INVENTION

Figure 3:
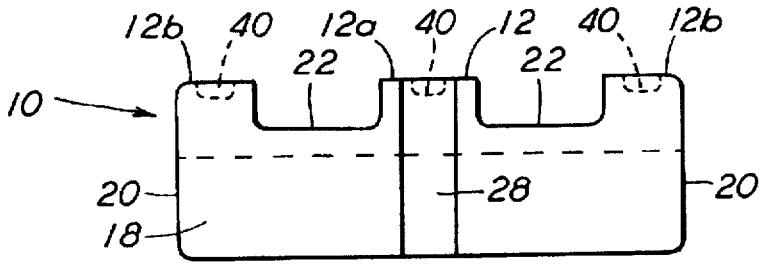
FIG. 3 is a top view of the gravity wedge shown in FIGS. 1 and 2.

Prior to proceeding with a more detailed description of the invention it should be noted that, for the sake of clarity, identical components having identical functions have been identified with identical reference numerals throughout the several views of the drawings.

Referring more particularly to the attached figures, illustrated therein are three views of a presently preferred embodiment of the gravity wedge of this invention, wherein the wedge comprises a cast or forged steel body of conventional wedge shape 10, having a pair of opposed wedge faces 12 and 14 at an inclined angle to each other, a blunted tip face 16 joining the closer lower proximate ends of the wedge faces 12 and 14, an outer face 18 opposite the tip face 16, and a pair of opposed and parallel side faces 20 extending transversely between the tip face 16 and the outer face 18. Normally, the wedge faces 12 and 14 are at an angle of about 10 degrees to each other. A first of the wedge faces, namely wedge face 12, is provided with a pair of rectangular recesses 22 therein in a side-by-side relationship equally spaced from an axis through the center of wedge face 12. As shown, the rectangular recesses 22 are in essence a pair of parallel slots ideally about 2.25 inches in width, spaced by a portion of wedge face **12*a* and providing a pair of outer portions of wedge face 12*b* on either outside of the slots 22. As is also shown, although not essential, the inclined face 14 does not extend at the inclined angle throughout the full length of face 14. Specifically, the lower portion of the gravity wedge 10 is provided with an identification area 24 which is a flat portion parallel to face 12. Useful information to the user is normally provided within the identification area such as part number, casting date, steel grade and manufacturer logo. As should be apparent, the identification area does not form a working part of the wedge and extends below the adjacent component against which inclined face 14 is intended to be biased. Such information is preferably printed with raised letters so that its visibility is not worn away by the wedging action of the gravity wedge 10** in contact with adjacent surfaces. Such identification areas are quite common on gravity wedges of the prior art and does not form any part of the inventive concept disclosed herein.

In addition to the identification area 24, side notches 26 and a top notch 28 are another feature which is common to the gravity wedges of the prior art. The notches 26 and 28 are merely tool notches which may be useful in the handling and installation of the gravity wedge and may be excluded or modified as necessary to meet requirements.

A three-dimensional, rectangular elastomeric pad 30 is rigidly bonded, such as by vulcanizing, within each recesses 22, such that an outer, flat surface of each elastomeric pad 30 is exposed and spaced outwardly from and parallel to the steel face 12 into which elastomeric pads 30 are bonded. Accordingly, the two outer faces of the two elastomeric pads 30 are aligned in the same plane intended to form an outer, elastomeric contact surface. Ideally, the outer elastomeric contact surface should extend at least about ¼ inch beyond or outwardly from the steel face 12. The size of elastomeric pads 30 should be such that they will consume the spaces created by recesses or slots 22, to provide the ¼-inch extension protruding therefrom, as described above. Essentially, the elastomeric pads 30 must be fabricated of an elastomeric material, such as neoprene, having a hardness of at least 50 durometers, and preferably 70 durometers. For optimum effect, the elastomeric pads 30 should provide a minimum of at least 30 square inches of exposed outer surface area (elastomeric contact surface area), and preferably at least about 38 square inches of contact surface area.

Figure 2:
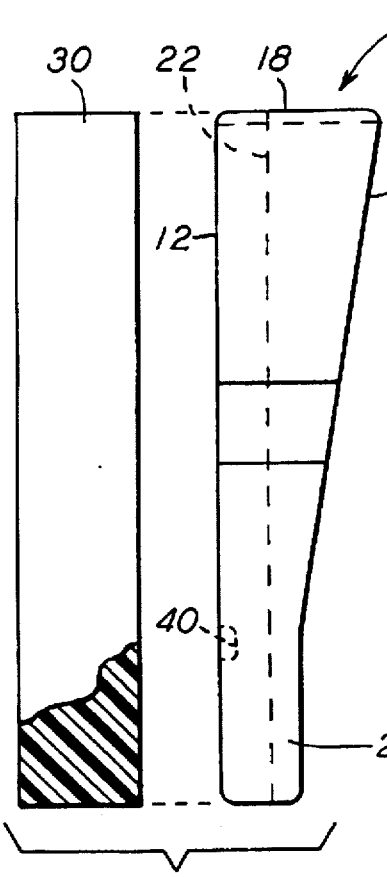
FIG. 2 is a side view of the gravity wedge shown in FIG. 1 with the elastomeric inserts spaced away therefrom the steel casting.
Figure 1:
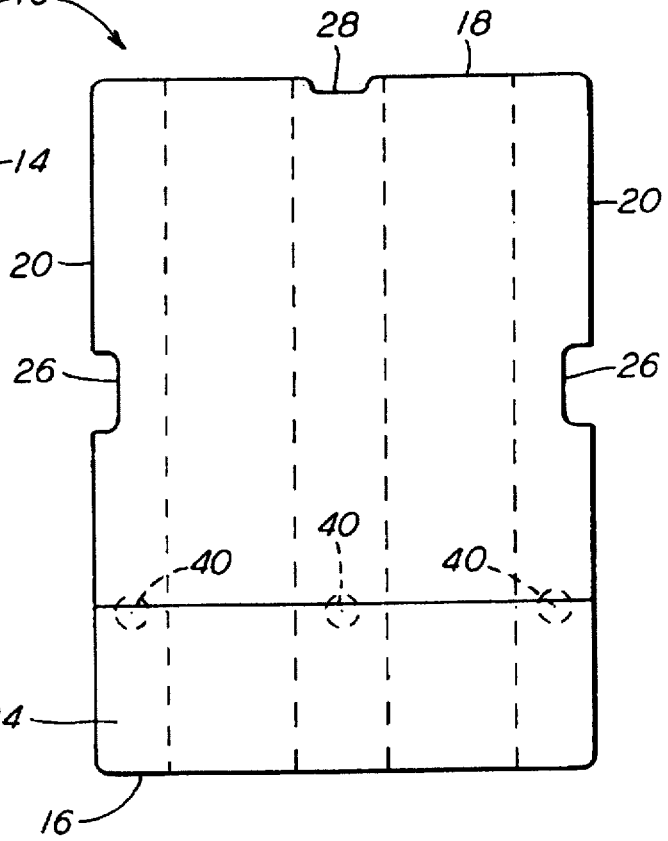
FIG. 1 is an elevational front view of a gravity wedge in accordance with a currently preferred embodiment of this invention.

As in more conventional gravity wedges, a wear indicator of some sort is preferably provided so that trainmen can tell at a glance when the drawbar system is worn to the point that replacement is required. Such a wear indicator is included in the gravity wedge illustrated in FIGS. 1–3 in the form of three circular and shallow recesses 40, one each provided in a horizontally aligned relationship in the lower portion of faces **12*a* and 12*b*. Accordingly, as with the prior art gravity wedge the inventive wedge is intended to replace, when the recesses 40 become visible below the adjacent component, this should be taken that the wedge 10** has worn to the point that replacement is necessary. Obviously, wear indicators can take one of several different forms and the positions thereof will vary depending upon the specific design of the coupling.

It is known that AAR specifications require a compressive load capacity on such gravity wedges of 1,250,000 pounds. The 38 square inches of elastomeric material at a hardness of 70 durometers is capable of supporting 60,000 pounds of force with only limited compressibility, which is more than adequate to meet AAR specifications.

While a presently preferred embodiment of the present invention has been described in detail above, it should be understood that persons skilled in the art may make various other modifications and adaptations of the invention without departing from the spirit or scope of the appended claims. For example, while two such elastomeric pads 30 are illustrated, obviously one such pad could be provided, as well as more than two, provided of course other criteria is satisfied such as the required contact surface area. When more than one elastomeric pad is provided, it is of course essential that the outer surfaces of each be aligned in a single plane so that they will matingly and uniformly abut against the adjacent component to provide an equal and uniform biasing action. Although rectangular elastomeric pads are illustrated, it should be readily apparent that other shapes could be utilized such as one or more circular pads. What ever shape and distribution is utilized, it should be apparent that the pads be uniformly exposed over the surface of the wedge so that any compression thereof as a result of buff loading will be uniform to avoid any tendency for the wedge to twist in place. While the bonding technique for securing the elastomeric pads within the recesses or slots is not critical, an ideal technique has been to use neoprene pads vulcanized to the base of the recesses, with two interval steel shims (not shown).

We claim:

1. A non-binding, slack-adjusting, gravity wedge member for use in a railway slackless drawbar system, said wedge member having a pair of opposed friction faces at an inclined angle to each other, a first of said faces having a recess therein receiving an elastomeric body bonded therein such that an outer, flat contact surface of said elastomeric body is exposed and spaced outwardly from and parallel to said first face.

2. A non-binding, slack-adjusting, gravity wedge member for use in a railway slackless drawbar system, according to claim 1, in which said friction faces are at an inclined angle of about ten degrees.

3. A non-binding, slack-adjusting, gravity wedge member for use in a railway slackless drawbar system, according to claim 2, in which said flat contact surface of said elastomeric body is spaced outwardly from said first face by a distance of at least ¼ inch.

4. A non-binding, slack-adjusting, gravity wedge member for use in a railway slackless drawbar system, according to claim 3, in which said first face is provided with two of said recesses therein each recess receiving a said elastomeric body.

5. A non-binding, slack-adjusting, gravity wedge member for use in a railway slackless drawbar system, according to claim 4, in which said two recesses are rectangular in form and side-by-side and aligned in a vertical direction of said gravity wedge member, such that two said elastomeric bodies are exposed in a side-by-side relationship.

6. A non-binding, slack-adjusting, gravity wedge member for use in a railway slackless drawbar system, according to claim 5, in which said two recesses comprise two slots which extend the vertical length of said first face such that said elastomeric bodies are exposed throughout the vertical length of said first face to provide two contact surfaces lying in the same plane.

7. A non-binding, slack-adjusting, gravity wedge member for use in a railway slackless drawbar system, according to claim 6, in which said elastomeric bodies are bonded within said recesses by vulcanizing said elastomeric bodies in place.

8. A non-binding, slack-adjusting, gravity wedge member for use in a railway slackless drawbar system, according to claim 7, in which said elastomeric bodies provide at least about 35 square inches of exposed, contact surface area.

9. A non-binding, slack-adjusting, gravity wedge member for use in a railway slackless drawbar system, according to claim 8, in which said elastomeric bodies provide approximately 38 square inches of exposed, contact surface area.

10. A non-binding, slack-adjusting, gravity wedge member for use in a railway slackless drawbar system, according to claim 8, in which said elastomeric bodies are fabricated of neoprene.

11. A non-binding, slack-adjusting, gravity wedge member for use in a railway slackless drawbar system, according to claim 8, in which said elastomeric bodies have a hardness of at least about 50 durometers.

12. A non-binding, slack-adjusting, gravity wedge member for use in a railway slackless drawbar system, according to claim 8, in which said elastomeric bodies have a hardness of approximately 70 durometers.

13. A non-binding, slack-adjusting, gravity wedge member for use in a railway slackless drawbar system, said wedge member having a pair of opposed friction faces at an inclined angle to each other, a first of said faces having at least one recess therein receiving an elastomeric body bonded therein such that an outer, flat surface of said elastomeric body is exposed and spaced outwardly from and parallel to said first face, said elastomeric body having an exposed outer flat surface of at least about 35 square inches, and a hardness of at least about 50 durometers.

14. A non-binding, slack-adjusting, gravity wedge member for use in a railway slackless drawbar system, according to claim 13, in which said first face has two said recesses therein, said recesses being of elongated rectangular form in a side-by-side relationship equally spaced on each side of a vertical axis on said first face.

15. A non-binding, slack-adjusting, gravity wedge member for use in a railway slackless drawbar system, according to claim 14, in which said first face is also provided with at least one wear indicator appropriately placed to become visible below associated hardware when the drawbar system components have worn to the point of needing replacement.

16. A non-binding, slack-adjusting, gravity wedge member for use in a railway slackless drawbar system, according to claim 15, in which said wear indicator is spaced approximately 10 inches down from an upper edge thereof.

17. A non-binding, slack-adjusting, gravity wedge member for use in a railway slackless drawbar system, according to claim 16, in which three said wear indicators are provided disposed in a parallel relationship, one on said first face between said elastomeric bodies, with one each on said first face adjacent to each outer edge of said elastomeric bodies.

18. A non-binding, slack-adjusting, gravity wedge member for use in a railway slackless drawbar system, according to claim 13, in which a pair of opposed tool grooves are provided in opposed side surface of said gravity wedge.

19. A non-binding, slack-adjusting, gravity wedge member for use in a railway slackless drawbar system, according to claim 18, in which a tool groove is provided in the upper edge surface of said gravity wedge centrally disposed between said elastomeric bodies.

20. A non-binding, slack-adjusting, gravity wedge member for use in a railway slackless drawbar system, according to claim 13, in which a second of said faces is provided with a non-inclined lower portion parallel to said first face upon which product information in imprinted.

* * * * *